US006983863B2

(12) United States Patent
Santy, Jr.

(10) Patent No.: US 6,983,863 B2
(45) Date of Patent: Jan. 10, 2006

(54) METHOD AND APPARATUS FOR BEVERAGE DISPENSING NOZZLE

(75) Inventor: John D. Santy, Jr., Converse, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 231 days.

(21) Appl. No.: 10/650,145

(22) Filed: Aug. 28, 2003

(65) Prior Publication Data

US 2005/0045655 A1 Mar. 3, 2005

(51) Int. Cl.
*B67D 5/56* (2006.01)

(52) U.S. Cl. ..... 222/129.1; 222/547; 222/145.5

(58) Field of Classification Search ..... 222/129.1, 222/145.5, 547
See application file for complete search history.

(56) References Cited

U.S. PATENT DOCUMENTS 5,203,474 A * 4/1993 Haynes ..... 222/129.1
6,047,859 A * 4/2000 Schroeder et al. ..... 222/145.5
6,098,842 A * 8/2000 Schroeder et al. ..... 222/129.1
6,345,729 B1 * 2/2002 Santy, Jr. ..... 222/129.1

* cited by examiner

*Primary Examiner*—Philippe Derakshani
(74) *Attorney, Agent, or Firm*—Christopher L. Makay

(57) ABSTRACT

A method and apparatus for a beverage dispensing nozzle equipped with at least one flow director dispenses at lower flowrates. In a first embodiment, a single flavor beverage dispensing nozzle equipped with at least one flow director segments the flow and reduces the cross sectional area of the fluid stream, thereby forcing product to move downward. A second embodiment provides an improvement to an existing beverage dispensing nozzle, by adding at least one flow director in an annular channel of the beverage dispensing nozzle. The addition of the at least one flow director in the annular channel provides the beverage dispensing nozzle with the ability to dispense product at lower flowrates by increasing the velocity component of the exiting product. The exiting product now has sufficient energy to separate from the beverage dispensing nozzle. Methods for using the beverage dispensing nozzles with the at least one flow director are also presented.

46 Claims, 13 Drawing Sheets

METHOD AND APPARATUS FOR BEVERAGE DISPENSING NOZZLE

BACKGROUND OF THE INVENTION

1. Field of the Invention

The present invention relates to beverage dispensing nozzles and more particularly, but not by way of limitation, to a beverage dispensing nozzle for use in dispensing medium to low flow applications. Further embodiments include dispensing flavor additives and dispensing multiple flavored drinks from a single nozzle without intermingling drink flavors.

2. Description of the Related Art

In the food and beverage service industry, counter space is at a premium. As such, it is desirable to minimize the space requirements of counter top dispensers through dispensing multiple flavors of drinks, including flavor additives, from a single nozzle. Problems associated with multiple flavor dispensing nozzles include syrup carryover, proper mixing, and excessive foaming problems. U.S. Pat. Nos. 6,098,842, 6,047,859 and 6,345,729 disclose multiple flavor nozzles that provide solutions to these problems. These multiple flavor nozzles are designed for use in high volume beverage dispensing accounts and thus produce higher than normal finished drink flowrates. While the designs of the referenced patents address the foregoing problems, they did not address problems associated with delivery of products at lower flowrates for medium to low volume beverage dispensing accounts. Furthermore, medium to low volume accounts may not require a multi-flavor beverage dispensing nozzle to satisfy the demand.

At lower flowrates, problems arise due to different system dynamics, wherein the product stream flows out of the nozzle in an irregular pattern and not the prescribed stream. Visually, the water segment of the product stream looks as if the water is exiting the nozzle on only one side. This training effect is present when the flow system energy does not overcome the surface tension properties of the mixing fluid in a lower flowrate system. This type of problem must be corrected to ensure proper mixing, as well as being aesthetically functional.

A second problem with the lower flowrate nozzles is the surface tension of the water as it leaves the underside of the nozzle. In a lower flowrate system, the water adhesion properties take over at the end of a dispense, wherein the mixing fluid then clings to the underside of the nozzle. Liquid clinging to the underside of the nozzle that contacts both the mixing fluid ports and the syrup ports can create avenues for intermingling of the different varieties of products, as well as discoloring and distaste of a dispensed drink. Accordingly, a beverage dispensing nozzle that operates at lower product flowrates would be beneficial for use in medium to low volume beverage dispensing accounts.

SUMMARY OF THE INVENTION

A method and apparatus for a beverage dispensing nozzle equipped with at least one flow director allow products to be dispensed at lower flowrates. In a first embodiment, a single flavor beverage dispensing nozzle equipped with the at least one flow director segment the flow to provide a reduced cross sectional area. As the nozzle cavity fills, the product is forced to move down a flow director channel. A method of using the beverage dispensing nozzle with the at least one flow director is also provided.

A second embodiment provides an improvement to an existing beverage dispensing nozzle, by adding at least one flow director in an annular channel of a multi-flavor beverage dispensing nozzle. The addition of the at least one flow director in the annular channel has provided the beverage dispensing nozzle with the ability to dispense product at lower flowrates by increasing the velocity component of the exiting product. The exiting product now has sufficient energy to separate from the beverage dispensing nozzle. A method of using the beverage dispensing nozzle with the at least one flow director is also presented.

It is therefore an object of this invention to provide a beverage dispensing nozzle suitable for use with lower flowrates.

It is further an object of this invention to provide an increased velocity component to the product exiting the beverage dispensing nozzle.

It is yet further an object of this invention to segment the flow of product within the beverage dispensing nozzle.

It is still yet further an object of this invention to provide a visually acceptable fluid stream exiting from the beverage dispensing nozzle.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

U.S. Pat. Nos. 6,098,842, 6,047,859 and 6,345,729, the disclosures of which are herein incorporated by reference, disclose a nozzle designed to mix beverage concentrates with a mixing fluid at high flowrates, up to 5 oz./sec. An important feature of the previously disclosed beverage dispensing nozzle is the annular discharge of a beverage syrup, wherein the annularly discharged mixing fluid contacts the beverage syrup in mid-air below the dispensing nozzle. The annular discharge shape of the beverage syrup and the mixing fluid significantly increases the contact surface area between the two streams, resulting in more effective mixing. The embodiments of this invention improve over the previously disclosed nozzle by broadening the working range of the nozzle, therein making the beverage dispensing nozzle suitable for use in lower flowrate applications, as well as the higher flowrate applications. Further embodiments of this invention include a single flavor beverage dispensing nozzle and dispensing of product flavorings.

Figure 1:
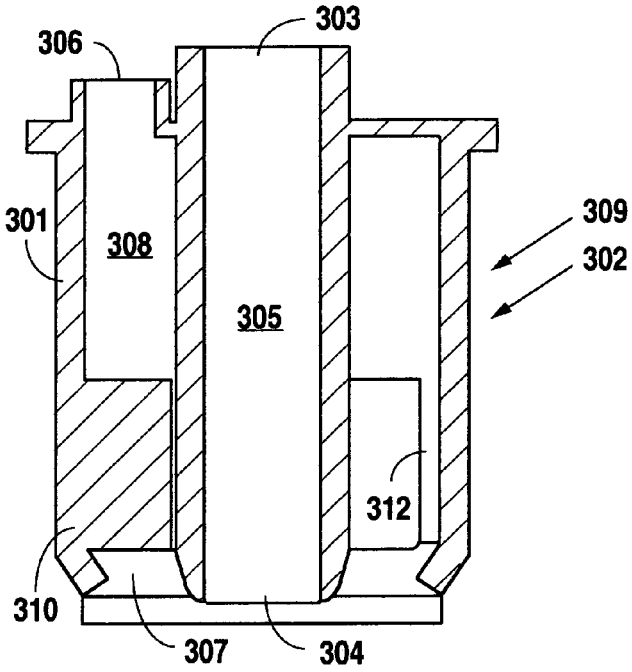
FIG. 1 provides a section view of a single flavor beverage dispensing nozzle according to the preferred embodiment.

As shown in FIG. 1, a first embodiment of a beverage dispensing nozzle 300 includes a body 301 having a single syrup flowpath 309 and a single mixing fluid flowpath 302. The syrup flowpath 309 includes a syrup inlet port 303, a syrup outlet port 304 and a beverage syrup channel 305. The mixing fluid flowpath 302 includes a mixing fluid inlet port 306, a mixing fluid outlet port 307 and a mixing fluid channel 308 disposed around the syrup flowpath 309. The mixing fluid channel 308 further includes at least one flow director 310 to increase the velocity of the mixing fluid. Multiple flow directors 310 may be used for increased control of the mixing fluid flow dynamics. The flow director 310 segments a lower portion of the large mixing fluid channel 308 into at least one smaller channel known as a flow director channel 312.

In operation, a beverage syrup is delivered to the beverage syrup inlet port 303 of the beverage dispensing nozzle 300 and a mixing fluid is delivered to the mixing fluid inlet port 306. The beverage syrup is then delivered from the beverage syrup inlet port 303 to the beverage syrup outlet port 304 via a beverage syrup channel 305 disposed in the nozzle 300. The beverage syrup is then discharged from the beverage syrup outlet port 304. The mixing fluid is delivered from the mixing fluid inlet port 306 to the mixing fluid channel 308 surrounding the syrup flow path 309. Once inside the mixing fluid channel 308, the mixing fluid flows towards the mixing fluid outlet port 307, therein passing the at least one flow director 310. Upon reaching the at least one flow director 310, the mixing fluid's downward velocity component is increased as the mixing fluid is forced through the reduced cross-sectional flow area and the hydraulic pressure of the incoming mixing fluid. The mixing fluid is then discharged from the mixing fluid outlet port 307 to contact exiting beverage syrup.

Figure 2:
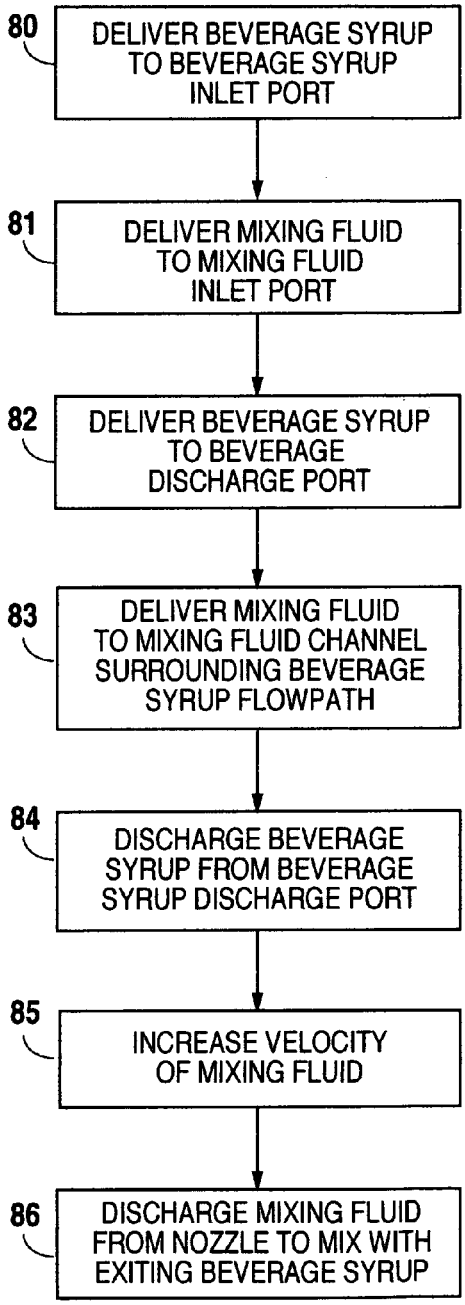
FIG. 2 provides a method flowchart for using flow directors in a single flavor nozzle according to the preferred embodiment.
Figure 3:
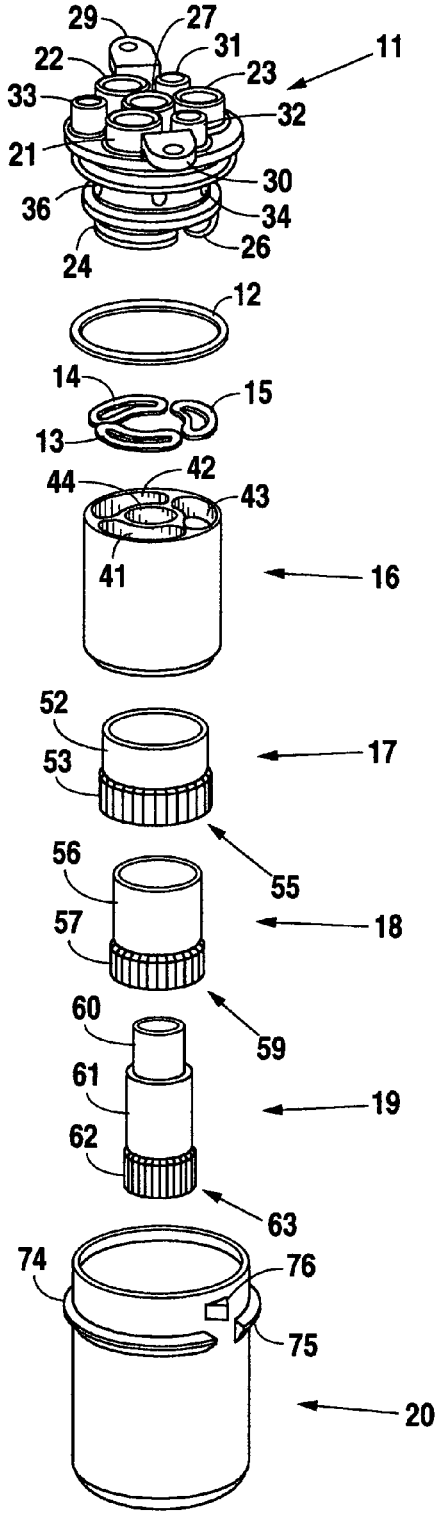
FIG. 3 provides an exploded view of beverage dispensing nozzle as viewed from above according to the preferred embodiment.
Figure 4:
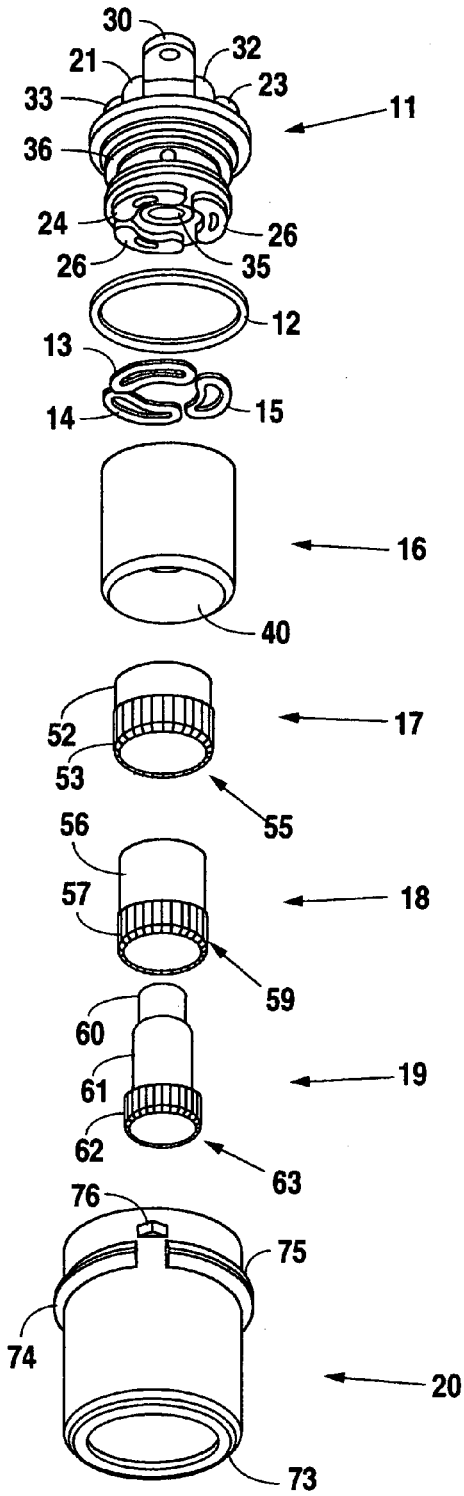
FIG. 4 provides an exploded view of nozzle as viewed from below according to the preferred embodiment.
Figure 6:
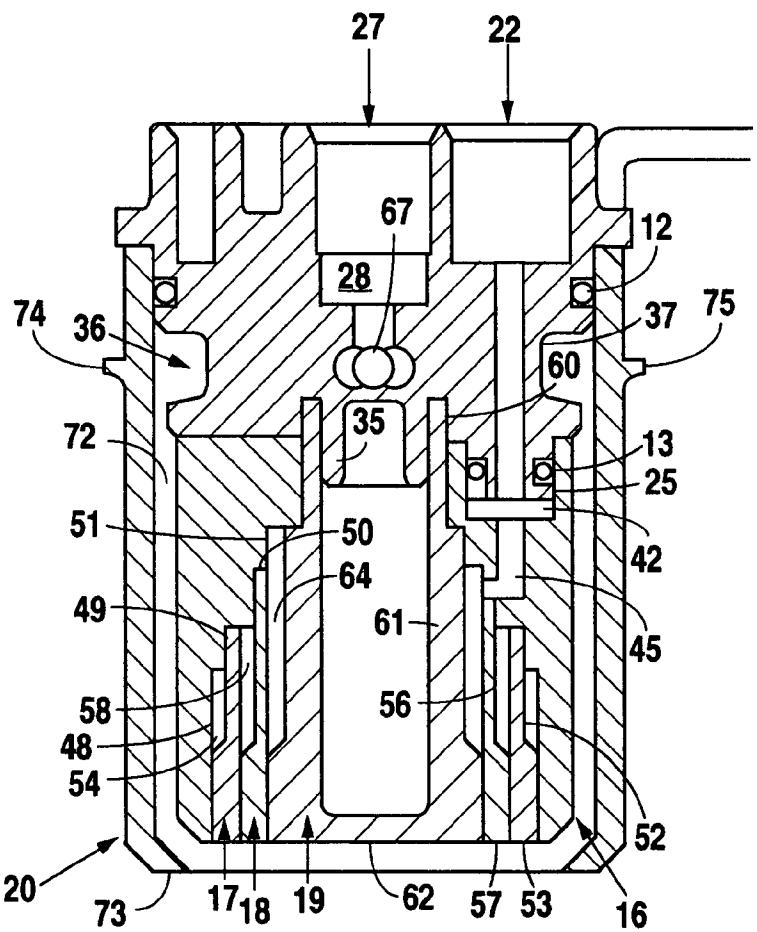
FIG. 6 is a cross section view of the nozzle as assembled according to the preferred embodiment.
Figure 5:
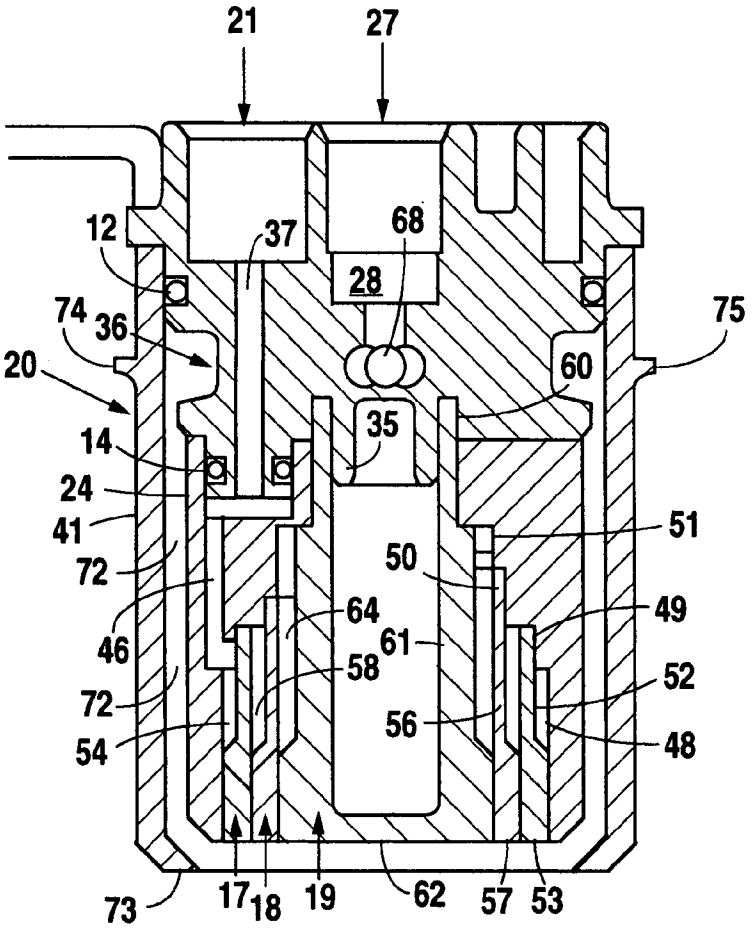
FIG. 5 is a cross section view of the nozzle as assembled according to the preferred embodiment.
Figure 7:
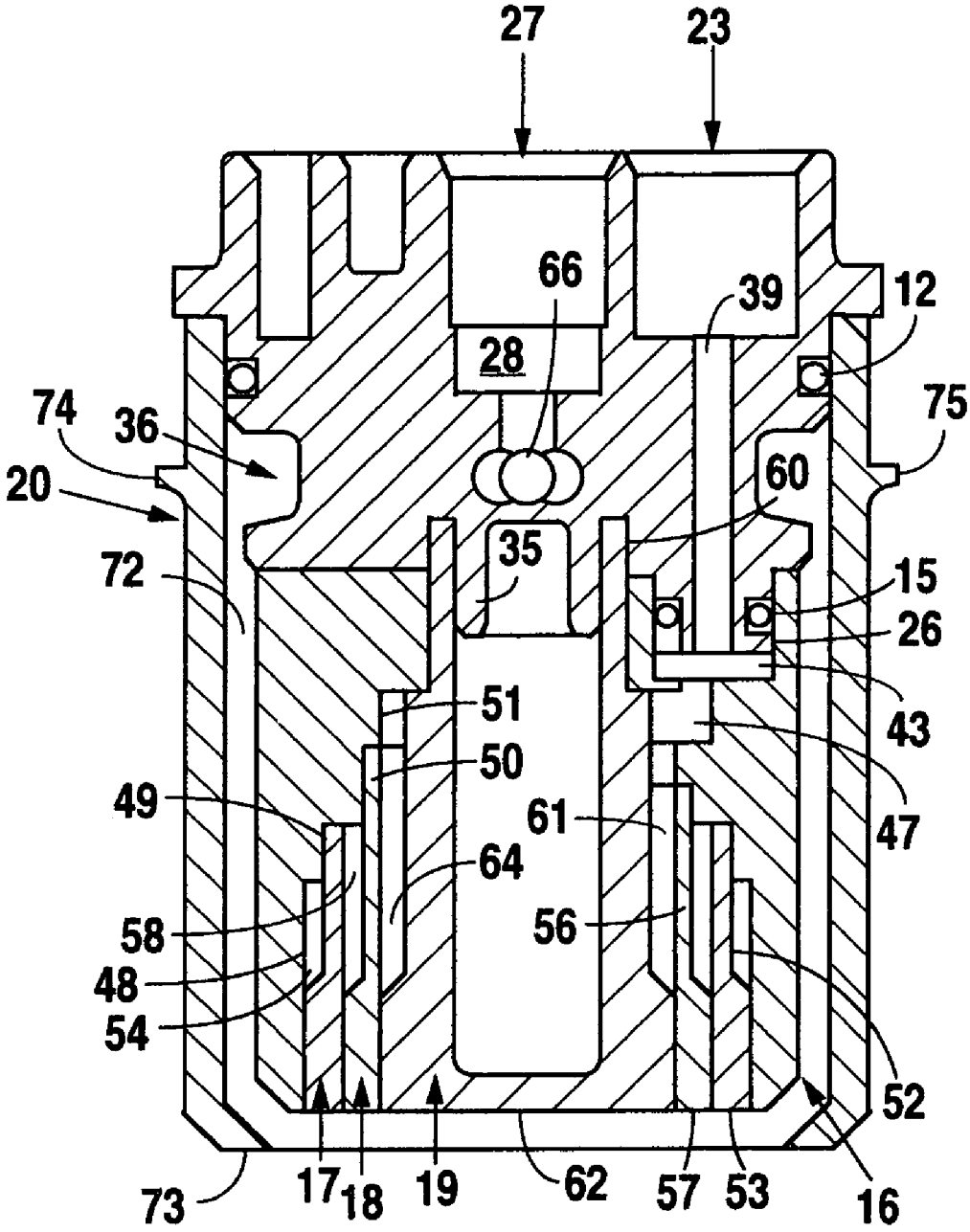
FIG. 7 is a cross section view of the nozzle as assembled according to the preferred embodiment.

As shown in FIG. 2, a method of using flow directors in a beverage dispensing nozzle 300 commences with step 80, delivering a beverage syrup to a beverage syrup inlet port 303 of the beverage dispensing nozzle 300. A mixing fluid is then delivered to a mixing fluid inlet port 306 of the beverage dispensing nozzle 300, step 81. In step 82, the beverage syrup is delivered from the beverage syrup inlet port 303 to a beverage syrup discharge port 304 via a syrup flowpath 309 disposed inside of the beverage dispensing nozzle 300. The method continues with step 83, wherein the mixing fluid is delivered from the mixing fluid inlet port 306 to the mixing fluid channel 308 surrounding the beverage syrup flowpath 309. Step 84 provides for the discharge of the beverage syrup from the beverage syrup discharge port 304. The velocity of the mixing fluid is increased as it passes the flow director 310 in the flow director channel 312 as shown in step 85. In step 86, the mixing fluid is discharged from the beverage dispensing nozzle 300 to mix with exiting beverage syrup.

In a second embodiment, a beverage dispensing nozzle 10 characteristic of the nozzle disclosed in the referenced U.S. Patents is equipped with an at least one flow director 200 to permit the nozzle 10 to operate at lower flowrates. As shown in FIGS. 3–7, the nozzle 10 includes a cap member 11, an o-ring 12, a plurality of gaskets 13–15, an inner housing 16, a first or outer annulus 17, a second or intermediate annulus 18, a third or inner annulus 19 and an outer housing 20. The inner housing 16 defines a chamber 40 and includes an opening 44 into the chamber 40. The inner housing 16 includes a plurality of cavities 41–43 that communicate with the chamber 40 through a plurality of conduits 45–47, respectively. The conduits 45–47 are concentrically spaced apart; namely, conduit 47 is innermost, conduit 45 is intermediate, and conduit 46 is outermost (see FIGS. 3–7). The conduits 45–47 are concentrically spaced apart so that beverage syrup may enter the chamber 40 at three separate points. The interior wall of the inner housing 16 defining the chamber 40 includes a plurality of stair steps 48–51.

The first or outer annulus 17 includes an upper member 52 and a discharge member 53. The first or outer annulus 17 fits within the chamber 40 of the inner housing 16 such that a portion of the upper member 52 engages the stair-step 49. That portion of the upper member 52 may press fit with the stair step 49 or an adhesive may be used to secure that portion of the upper member 52 with the stair step 49. The first or outer annulus 17 and the interior wall of the inner housing 16 defining stair step 48 form a first beverage syrup channel 54 that connects with the conduit 46 of the inner housing 16. The first beverage syrup channel 54 insures a large volume of beverage syrup flows uniformly about the first or outer annulus 17 during discharge. The discharge member 53 includes a plurality of discharge channels 55 to aid the first beverage syrup channel 54 in discharging the beverage syrup because the discharge member 53 is sized to substantially reside within the lower portion of the interior wall for the inner housing 16. The discharge member 53 operates to discharge the beverage syrup in a restricted flow to insure uniform distribution of the beverage syrup as it exits from the beverage dispensing nozzle 10, thereby providing a maximum surface area for contact with mixing fluid also exiting from the beverage dispensing nozzle 10.

The second or intermediate annulus 18 includes an upper member 56 and a discharge member 57. The second or intermediate annulus 18 fits within the first or outer annulus 17 such that a portion of the upper member 56 engages the stair step 50. That portion of the upper member 56 may press fit with the stair step 50 or an adhesive may be used to secure that portion of the upper member 56 with the stair step 50. The second or intermediate annulus 18 and the interior wall of the first or outer annulus 17 form a second beverage syrup channel 58 that connects with the conduit 45 of the inner housing 16. The second beverage syrup channel 58 insures a large volume of beverage syrup flows uniformly about the second or intermediate annulus 18 during discharge. The discharge member 57 includes a plurality of discharge channels 59 to aid the second beverage syrup channel 58 in discharging the beverage syrup because the discharge member 57 is sized to substantially reside within the lower portion of the interior wall of the first or outer annulus 17. The discharge member 57 operates to discharge the beverage syrup in a restricted flow to insure uniform distribution of the beverage syrup as it exits from the beverage dispensing nozzle 10, thereby providing a maximum surface area for contact with mixing fluid also exiting from the beverage dispensing nozzle 10.

The third or inner annulus 19 includes a securing member 60, an intermediate member 61 and a discharge member 62. The inner annulus 19 fits within the intermediate annulus 18 such that the securing member 60 protrudes through the opening 44 of the inner housing 16 and engages the interior wall of the inner housing 16 defining the opening 44. The securing member 60 may be press fit with the interior wall of the inner housing 16 defining the opening 44 or an adhesive may be used to secure the securing member 60 with the interior wall of the inner housing 16 defining the opening 44. The third or inner annulus 19, the stair step 51 and the interior wall of the second or intermediate annulus 18 form a third beverage syrup channel 64 that connects with the conduit 47 of the inner housing 16. The third beverage syrup channel 64 insures a large volume of beverage syrup flows uniformly about the third or interior annulus 19 during discharge. The discharge member 62 includes a plurality of discharge channels 63 to aid the third beverage syrup channel 64 in discharging the beverage syrup because the discharge member 62 is sized substantially reside within the lower portion of the interior wall for the second or intermediate annulus 18. The discharge member 62 operates to discharge the beverage syrup in a restricted flow to insure uniform distribution of the beverage syrup as it exits from the beverage dispensing nozzle 10, thereby providing a maximum surface area for contact with mixing fluid also exiting from the beverage dispensing nozzle 10.

The cap member 11 includes a plurality of beverage syrup inlet ports 21–23 that communicate with a respective beverage syrup outlet port 24–26 via a respective connecting conduit 37–39 through the cap member 11. The beverage syrup outlet ports 24–26 snap fit within a respective cavity 41–43 of the inner housing 16 to secure the inner housing 16 to the cap member 11. The gaskets 13–15 fit around a respective beverage syrup outlet port 24–26 to provide a fluid seal and to assist in the securing of the inner housing 16 to the cap member 11. With the inner housing 16 secured to the cap member 11, a beverage syrup path involving the beverage syrup inlet port 21; the conduit 37; the beverage syrup outlet port 24; the cavity 41; the conduit 46; and the first beverage syrup channel 54, which includes the discharge channels 59 is created. A beverage syrup path involving the beverage syrup inlet port 22; the conduit 38; the beverage syrup outlet port 25; the cavity 42; the conduit 45; the second beverage syrup channel 58, which includes the discharge channels 55, and one involving the beverage syrup inlet port 23; the conduit 39; the beverage syrup outlet port 26; the cavity 43; the conduit 47; the third beverage syrup channel 64, which includes the discharge channels 63 are also created.

The cap member 11 includes a mixing fluid inlet port 27 that communicates with a plurality of mixing fluid outlet channels 66–71 via a connecting conduit 28 through the cap member 11. The mixing fluid outlet channels 66–71, in this preferred embodiment, are uniformly spaced within the cap member 11 and communicate with an annular cavity 36 defined by a portion of the cap member 11 to deliver mixing fluid along the entire circumference of the annular cavity 36. Nevertheless, one of ordinary skill in the art will recognize that other mixing fluids, such as plain water may be used. Furthermore, although the preferred embodiment discloses the formation of a beverage from a beverage syrup and a mixing fluid, such as carbonated water or plain water, one of ordinary skill in the art will recognize that a mixing fluid, such as carbonated or plain water, may be dispensed individually from a beverage path as described above instead of a beverage syrup.

The outer housing 20 snap fits over the cap member 11, including the o-ring 12 which provides a fluid seal and assists in the securing of the inner housing 16 to the cap member 11. The outer housing 20 has an inwardly extending lip portion 73 at its exit end to direct exiting mixing fluid into the exiting beverage syrup. An inner surface 201 of the outer housing 20 in combination with the portion of the cap member 11 defining the annular cavity 36 and an exterior wall 202 of the inner housing 16 define a mixing fluid channel 72. With the outer housing 20 secured to the cap member 11, a mixing fluid path involving the mixing fluid inlet port 27, the conduit 28, the mixing fluid outlet channels 66-71, the annular channel 36 and the mixing fluid channel 72 is created.

Similarly, upon mating the outer housing 20 and the cap member 11, three different beverage flow paths are defined. Beverage syrup enters the beverage syrup inlet ports 21,22, 23, flows through the conduits 37,38,39 and the beverage system outlet ports 24,25,26 to the cavities 41,42,43; the beverage syrup then flows through the conduits 46,45,47, the first, second and third beverage syrup channels 54,58,64, the discharge channels 55,59,63, and the discharge members 53,57,62, respectively, prior to being discharged from the beverage dispensing nozzle 10.

In operation, mixing fluid enters the beverage dispensing nozzle through the mixing fluid inlet port 27 and travels through the conduit 28 to the mixing fluid outlet channels 66–71 for delivery into the annular cavity 36. Under high flow rates, the annular cavity 36 receives a large volume of mixing fluid to insure the mixing fluid channel 72 remains full for uniform flow as the mixing fluid moves downwardly through the mixing fluid channel 72 to the discharge end of the nozzle. The objective is to maintain a uniform distribution of mixing fluid exiting the entire circumference of the mixing fluid channel 72. The inwardly extending lip portion 73 of the outer housing 20 directs the mixing fluid inwardly toward a beverage syrup stream exiting from one of the discharge members 53, 57, or 62.

The beverage syrup inlet ports 21–23 each receive a different flavor of beverage syrup, which is delivered through a conduit by a beverage syrup source (not shown). Each beverage syrup travels through its particular flow path for discharge from the beverage dispensing nozzle 10 as previously described. Illustratively, a beverage syrup delivered to the beverage syrup inlet port 21 flows through the conduit 37, the beverage syrup outlet port 24, the cavity 41, the conduit 46, the first beverage syrup channel 54, and the discharge channels 55 prior to discharge from the beverage dispensing nozzle 10. The first, second ad third beverage syrup channels 54, 58, and 64 provide a large volume of beverage syrup around each of a respective first or outer, second or intermediate, and third or inner annulus 17, 18, and 19 for discharge through one of the discharge members 53, 57, and 62. The discharge members 53, 57, and 62 restrict the flow of beverage syrup to insure uniform distribution of the beverage syrup as it exits from the beverage dispensing nozzle 10, thus insuring a maximum surface area for contact with the mixing fluid exiting from the mixing fluid channel 72. Although only one beverage syrup is typically dispensed at a time, it should be understood that more than one beverage syrup may be discharged from the beverage dispensing nozzle 10 at a time to provide a mix of flavors.

Figure 8A:
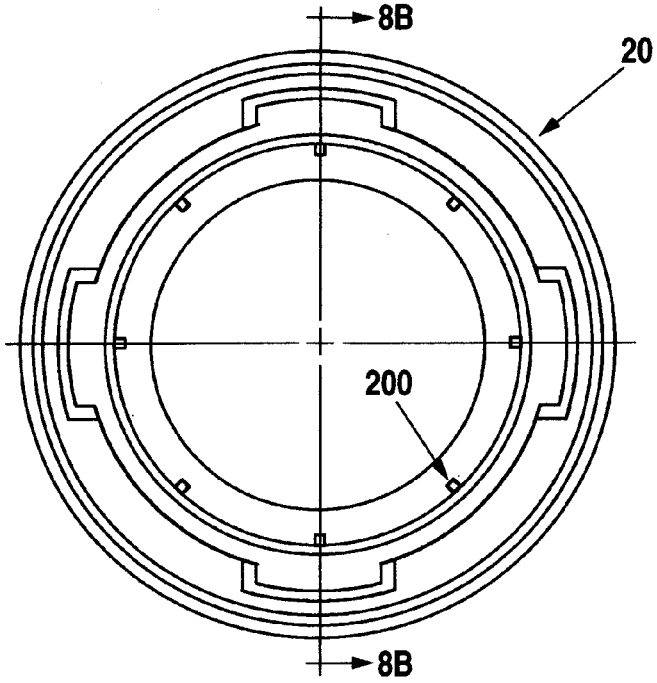
FIG. 8*a* is a top view of the outer housing after the addition of flow directors according to the preferred embodiment.
Figure 8B:
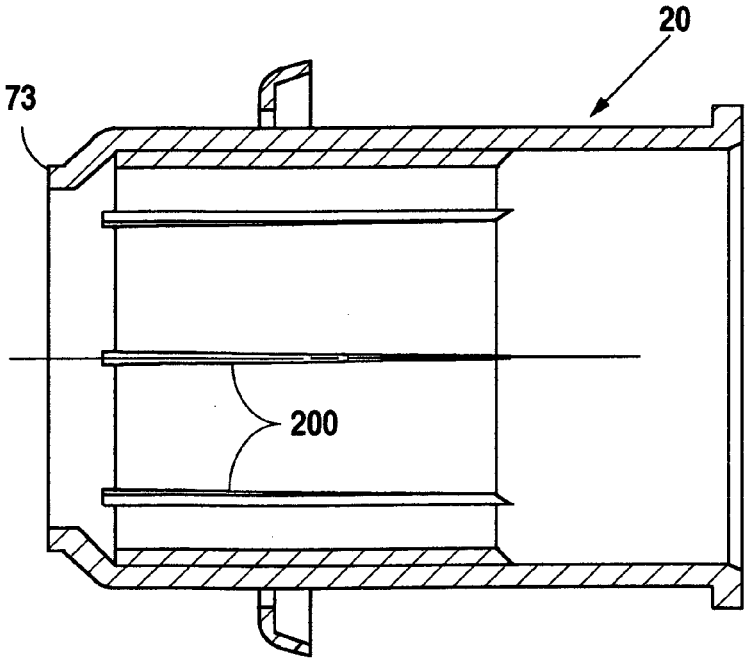
FIG. 8*b* is a section view of the outer housing after addition of the flow directors according to the preferred embodiment.

As a solution to the problems associated with dispensing at lower flowrates, the outer housing 20 of the nozzle 10 has been outfitted with a plurality of flow directors 200, eight in this preferred embodiment, on an inner surface 201 of the outer housing 20. The flow directors 200 extend upward from the inwardly extending lip portion 73 at its exit end to the edge of the inner surface 201 as shown in FIGS. 8*a* and 8*b*. The flow directors 200 do not run the full length of the mixing fluid channel 72. Full-length flow directors 200 would prevent the filling of an upper section of the mixing fluid channel 72 around the beverage syrup flowpath. The addition of the flow directors 200 segments a lower section of the mixing fluid channel 72 into a plurality of smaller flow channels or flow director channels 210. It should be noted that the quantity and length of flow director 200 features may vary depending on mixing requirements for different products and additives.

Figure 9A:
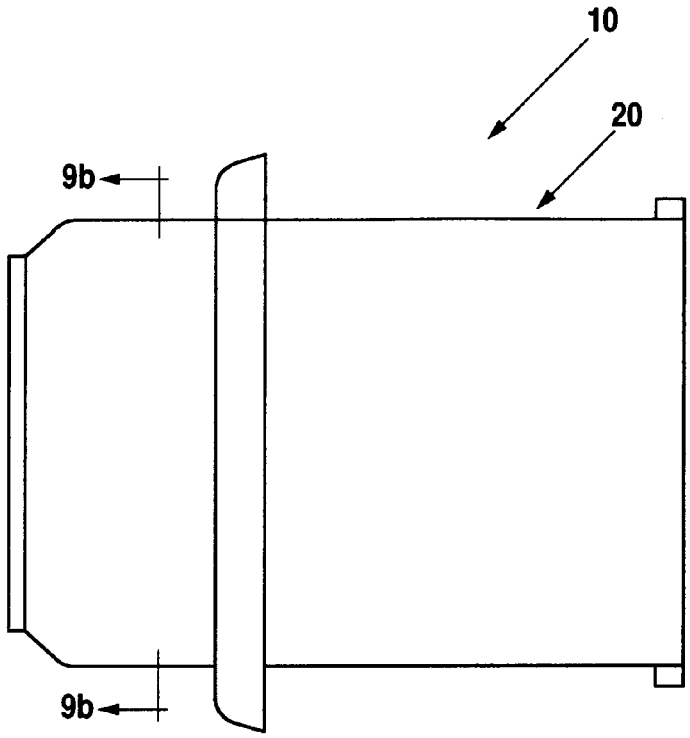
FIG. 9*a* provides a side view of the assembled beverage dispensing nozzle according to the preferred embodiment.
Figure 9B:
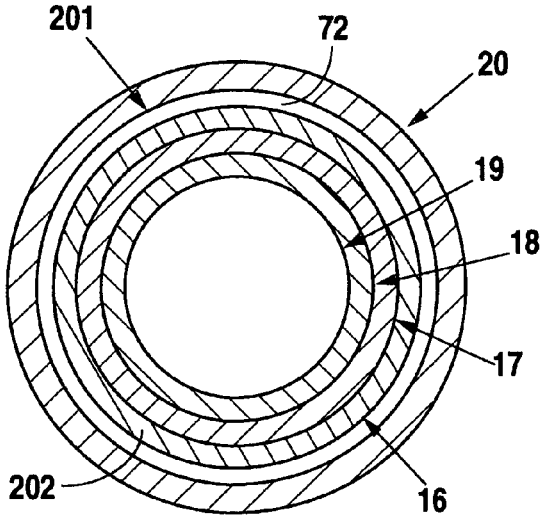
FIG. 9*b* provides a section view of the beverage dispensing nozzle before the addition of flow directors according to the preferred embodiment.
Figure 9C:
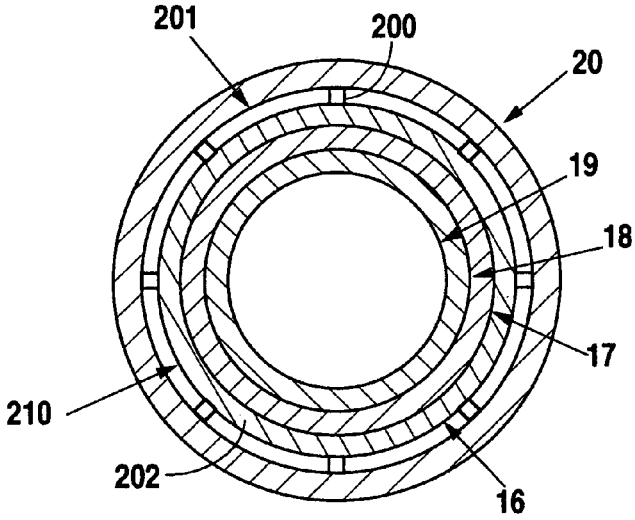
FIG. 9*c* provides a section view of the beverage dispensing nozzle after the addition of flow directors according to the preferred embodiment.

With the installation of flow directors 200, assembly of the cap member 11 and the outer housing 20 now define a slightly different flow path for the mixing fluid. The inner surface 201 of the outer housing 20 in combination with the portion of the cap member 11 defining the annular cavity 36 and the exterior wall 202 of the inner housing 16 define the mixing fluid channel 72 which now encompasses flow director channels 210. The flow director channels 210 are defined by the inner surface 201 of the outer housing 20, the outer wall 202 of the inner housing 16, and two adjacent flow directors 200 as shown in FIG. 9*c*. FIGS. 9*b* and 9*c* provide section views of the beverage dispensing nozzle 10 before and after the addition of flow directors 200. With the outer housing 20 secured to the cap member 11, a mixing fluid path involving the mixing fluid inlet port 27, the conduit 28, the mixing fluid outlet channels 66–71, the annular channel 36, the mixing fluid channel 72 and the flow director channels 210 is created.

With the flow directors 200 in place, the upper section of the mixing fluid channel 72 fills with mixing fluid. Once filled, the hydraulic pressure of the incoming mixing fluid forces the mixing fluid in the upper section of the mixing fluid channel 72 into the series of flow director channels 210 defined by the flow directors 200. The reduced cross sectional area of the flow director channels 210 provides an increased velocity component for the mixing fluid exiting the nozzle 10 since the velocity component of the mixing fluid is being directed downward through all of the flow director channels 210. The increased velocity component provides the mixing fluid stream with enough energy to separate from the nozzle 10 at the end of the dispense. The increased velocity of the mixing fluid eliminates the problem of the mixing fluid clinging to the underside of the nozzle 10, and crossing over into other discharge ports. The addition of flow directors 200 improves the distribution of mixing fluid by regaining the desired discharge velocity for a more effective mix.

In a dispense, the syrup and mixing fluid flow separately through the nozzle 10 to mix with beverage syrup discharged from the nozzle 10. Illustratively, syrup enters the nozzle 10 through a syrup inlet port 21, flows through the conduit 37, moves into the beverage system outlet port 24 to the cavity 41; the syrup then flows through the conduit 46, the beverage syrup channel 54, the discharge channel 55, and finally, the discharge member 53. Concurrently, a mixing fluid enters the nozzle 10 through the mixing fluid inlet port 27, moves through the conduit 28, exits the mixing fluid outlet channels 66–71, flows into the annular channel 36, through the mixing fluid channel 72, and flows through the flow director channels 210 to the end of the nozzle 10. Once the mixing fluid exits the flow director channels 210, it is redirected inward into the syrup stream exiting the nozzle 10 by the inwardly extending lip portion 73. As both fluids are being dispensed in concentric annular rings, the opportunity for mixing is increased. While the preferred embodiment provides for annularly shaped discharging of the syrup and mixing fluid, it should be apparent to those of ordinary skill in the art, that the shape of the discharge streams is not limited to annular rings. Additionally, it should be further apparent to one skilled in the art that the beverage syrup and the mixing fluid flowpaths may be switched for products with fractional mixing ratios, wherein the mixing fluid could exit the center of the beverage dispensing nozzle.

Figure 10:
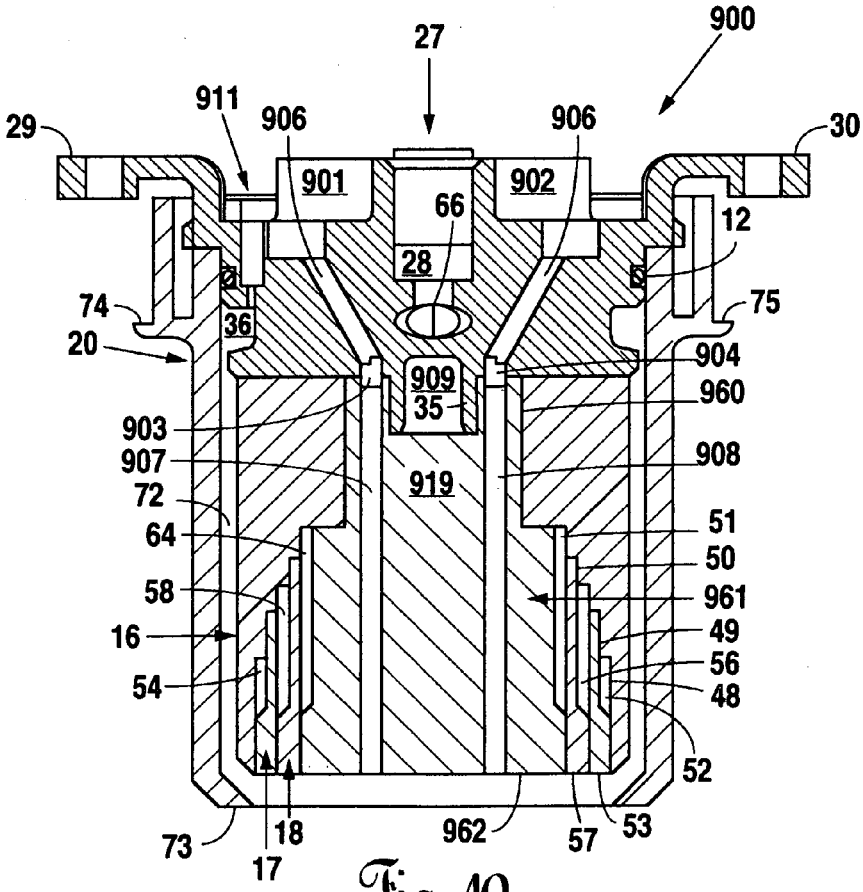
FIG. 10 provides a cross section of an embodiment of the beverage dispensing nozzle that inlcudes flavor additives according to the preferred embodiment.

As illustrated in FIG. 10, an embodiment of the beverage dispensing nozzle 900 provides for delivery of flavor additives from the beverage dispensing nozzle 900 along with beverage syrup and mixing fluid. Examples of flavor additives in this embodiment include, but are not limited to, cherry or vanilla, which are utilized to form new drink combinations such as cherry cola. In this embodiment, the third or inner annulus 919 includes a securing member 960, an intermediate member 961, and a discharge member 962. The third or inner annulus 919 mounts within the second or intermediate annulus 18, protrudes through the opening of the inner housing 16, and engages the interior wall of the inner housing 16 defining the opening identically as previously described with reference to the beverage dispensing nozzle 10. The third or inner annulus 919, however, includes a pair of passageways 907 and 908 therethrough, which are utilized to deliver flavor additives from the third or inner annulus 919. The intermediate member 961 and the discharge member 962 are identical to the intermediate member 61 and the discharge member 62 of the third or inner annulus 19, except the intermediate member 961 and the discharge member 962 define a portion of the passageways 907 and 908. The securing member 960 is identical to the securing member 60 of the third annulus 919, except the securing member 60 defines a cavity 909 as well as a portion of the passageways 907 and 908.

The cap member 911 is configured and operates as the cap member 11, except the cap member 911 further includes a plurality of flavor additive inlet ports 901 and 902 that communicate with a respective flavor additive outlet port 903 and 904 via a respective connecting passageway 905 and 906 through the cap member 911. Identical to the cap member 11, beverage syrup outlet ports of the cap member 911 snap fit within a respective cavity of the inner housing 16 to secure the inner housing 16 to the cap member 911. Gaskets fit around a respective beverage syrup outlet port to provide a fluid seal and to assist in the securing of the inner housing 16 to the cap member 911. In addition, the securing member 960 of the third or inner annulus 919 extending through the opening of the inner housing 16 snap fits around a protrusion 35 of the cap member 911 to aid in the securing of the inner housing 16 to the cap member 911. With the inner housing 16 secured to the cap member 911, a flavor additive conduit involving the flavor additive inlet port 901; the passageway 905; the flavor additive outlet port 903; and the passageway 907 is created. Similarly, a flavor additive conduit involving the flavor additive inlet port 902; the passageway 906; the flavor additive outlet port 904; and the passageway 908 is created.

The operation of the beverage dispensing nozzle 900 in delivering a mixing fluid for combination with a beverage syrup to produce a desired drink is identical to the operation of the beverage dispensing nozzle 10. However, the beverage dispensing nozzle 900 provides a user the option of altering drink flavor through the addition of flavor additives, such as cherry or vanilla, delivered from flavor additive sources. When the user has selected a flavor additive, the flavor additive enters a respective passageway 907 or 908 via a respective passageway 905 or 906 and flavor additive outlet port 903 and 904. The selected additive flavor traverses a respective passageway 907 or 908 and exits the third or inner annulus 919, where the flavor additive combines with the flowing beverage syrup and mixing fluid to produce an alternatively flavored drink, such as cherry or vanilla cola.

Figure 11A:
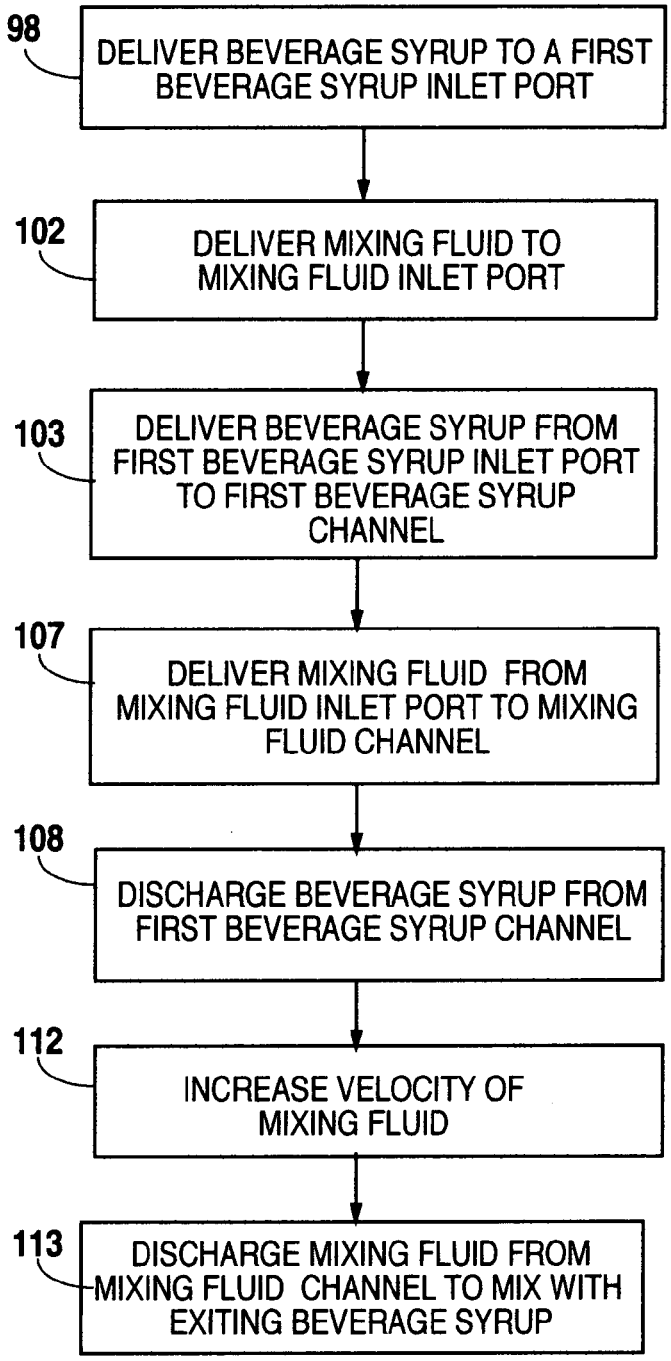
FIG. 11*a* provides a method flowchart for using flow directors in a beverage dispensing nozzle with a single beverage flavor according to the preferred embodiment.

A method flowchart for using flow directors 200 in a beverage dispensing nozzle 10 mixing a single beverage syrup and a mixing fluid is shown in FIG. 11*a*. The process begins with step 98, wherein a beverage syrup is delivered to a first beverage syrup inlet port 21. In step 102, a mixing fluid is delivered to a mixing fluid inlet port 27. Step 103 provides for delivering the beverage syrup from the first beverage syrup inlet port 21 to the first beverage syrup channel 54. Next, the mixing fluid is delivered from the mixing fluid inlet port 27 to the mixing fluid channel 72, step 107. The process continues with step 108, wherein the beverage syrup is discharged from the first beverage syrup channel 54. In step 112, the velocity of the mixing fluid is increased as the mixing fluid passes the flow directors 200. Step 113 provides for discharging the mixing fluid from the mixing fluid channel 72 to contact exiting beverage syrup to mix therewith outside of the beverage dispensing nozzle 10.

Figure 11B:
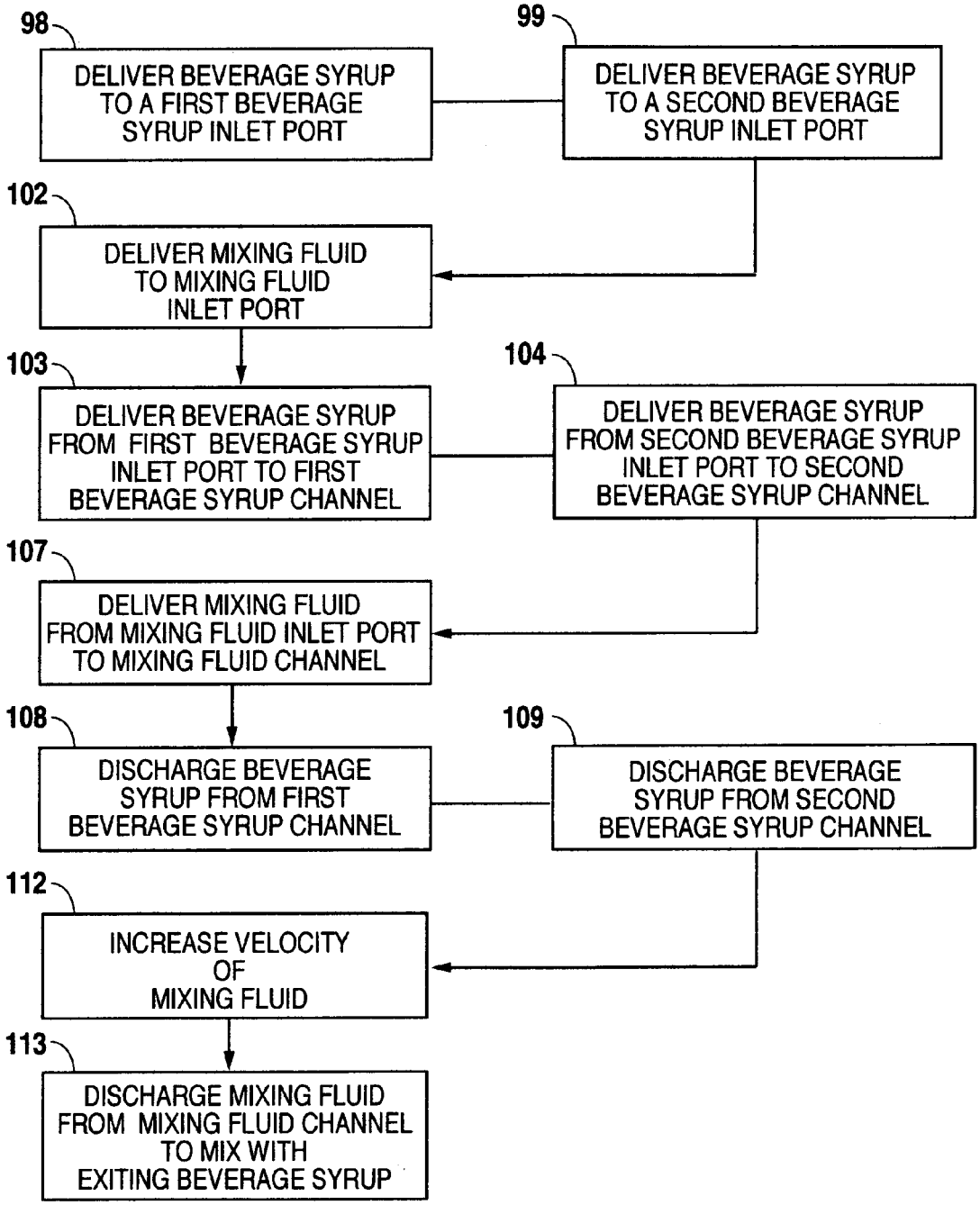
FIG. 11*b* provides a method flowchart for using flow directors in a beverage dispensing nozzle with two beverage flavors according to the preferred embodiment.

In embodiments where a second beverage dispensing stream is also being dispensed from the nozzle 10, the method of FIG. 11*a* would further include steps 99, 104 and 109 as shown in FIG. 11*b*. Similarly, the process begins with step 98, wherein a beverage syrup is delivered to a first beverage syrup inlet port 21. A second beverage syrup is then delivered to a second beverage syrup inlet port 22 as shown in step 99. Next, step 102, a mixing fluid is delivered to a mixing fluid inlet port 27. The process then moves to step 103, wherein the first beverage syrup is delivered form the first beverage syrup inlet port 21 to a first beverage syrup channel 54. In step 104, the second beverage syrup is delivered to a second beverage syrup channel 58. The mixing fluid is delivered from the mixing fluid inlet port 27 to a mixing fluid channel 72 in step 107. Next, the first beverage syrup is discharged from the first beverage syrup channel 54, step 108. Likewise, the second beverage syrup is discharged from the second beverage syrup channel 58, step 109. In step 112, the velocity of the mixing fluid is increased by passing it through the flow directors 200. The mixing fluid is then discharged from the mixing fluid channel 72 to mix therewith outside of the beverage dispensing nozzle 10 with exiting beverage syrup.

Figure 11C:
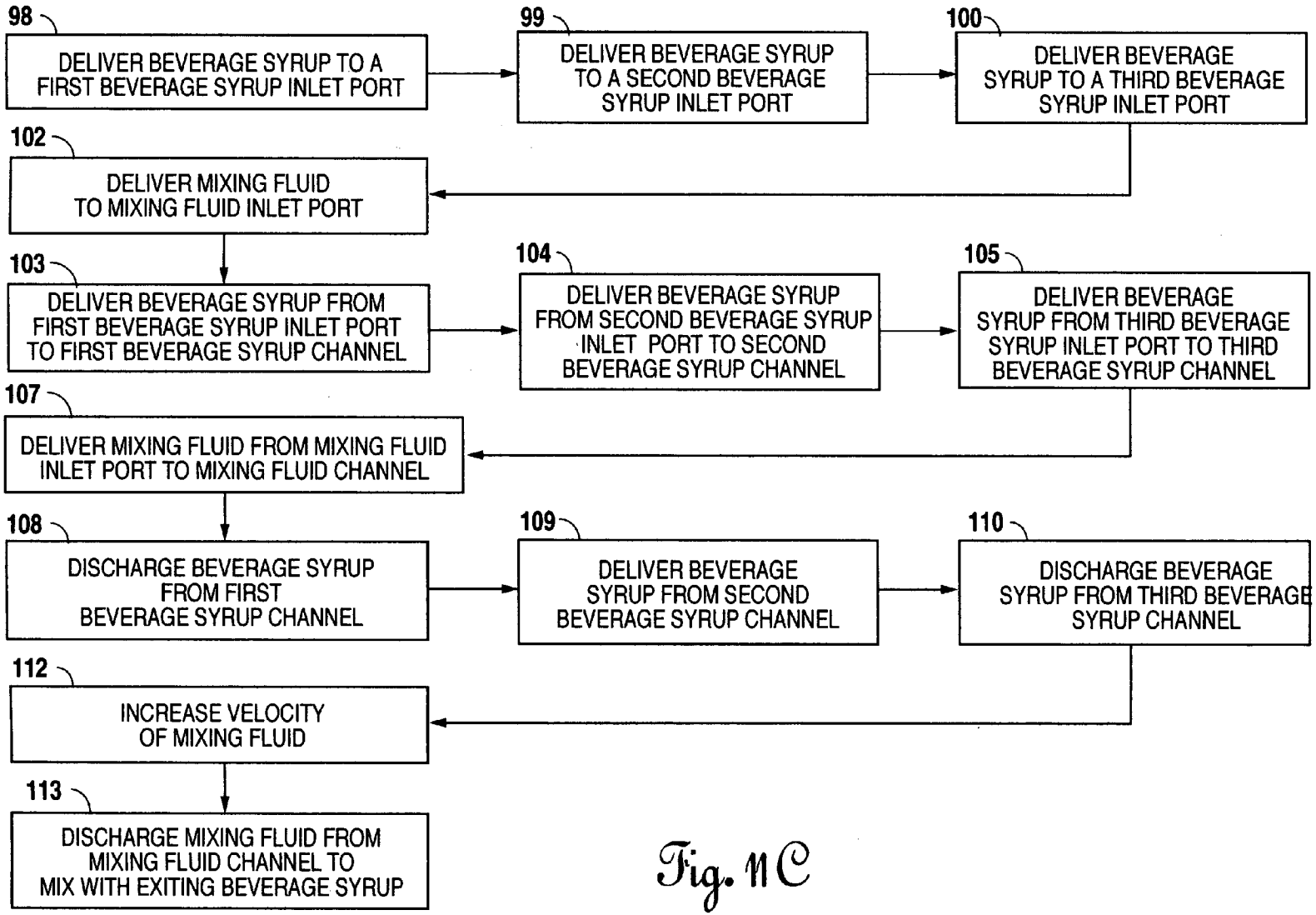
FIG. 11*c* provides a method flowchart for using flow directors in a beverage dispensing nozzle with three beverage flavors according to the preferred embodiment.

In an embodiment wherein three syrups are desired, the method of FIG. 11*b* further includes steps 100, 105 and 110, as shown in FIG. 11*c*. Similarly, the process begins with step 98, wherein a beverage syrup is delivered to a first beverage syrup inlet port 21. A second beverage syrup is then delivered to a second beverage syrup inlet port 22 as shown in step 99. In step 100, a third beverage syrup is delivered to a third beverage syrup inlet port 23. Next, step 102, a mixing fluid is delivered to a mixing fluid inlet port 27. The process then moves to step 103, wherein the first beverage syrup is delivered form the first beverage syrup inlet port 21 to a first beverage syrup channel 54. In step 104, the second beverage syrup is delivered to a second beverage syrup channel 58. The process then moves to step 105, wherein the third beverage syrup is delivered to a third beverage syrup channel 63. The mixing fluid is delivered from the mixing fluid inlet port 27 to a mixing fluid channel 72 in step 107. Next, the first beverage syrup is discharged from the first beverage syrup channel 54, step 108. Likewise, the second beverage syrup is discharged from the second beverage syrup channel 58, step 109, and the third beverage syrup is discharged from the third beverage syrup channel 63, step 110. In step 112, the velocity of the mixing fluid is increased by passing it through the flow directors 200. The mixing fluid is then discharged from the mixing fluid channel 72 to mix therewith outside of the beverage dispensing nozzle 10 with exiting beverage syrup.

Figure 11D:
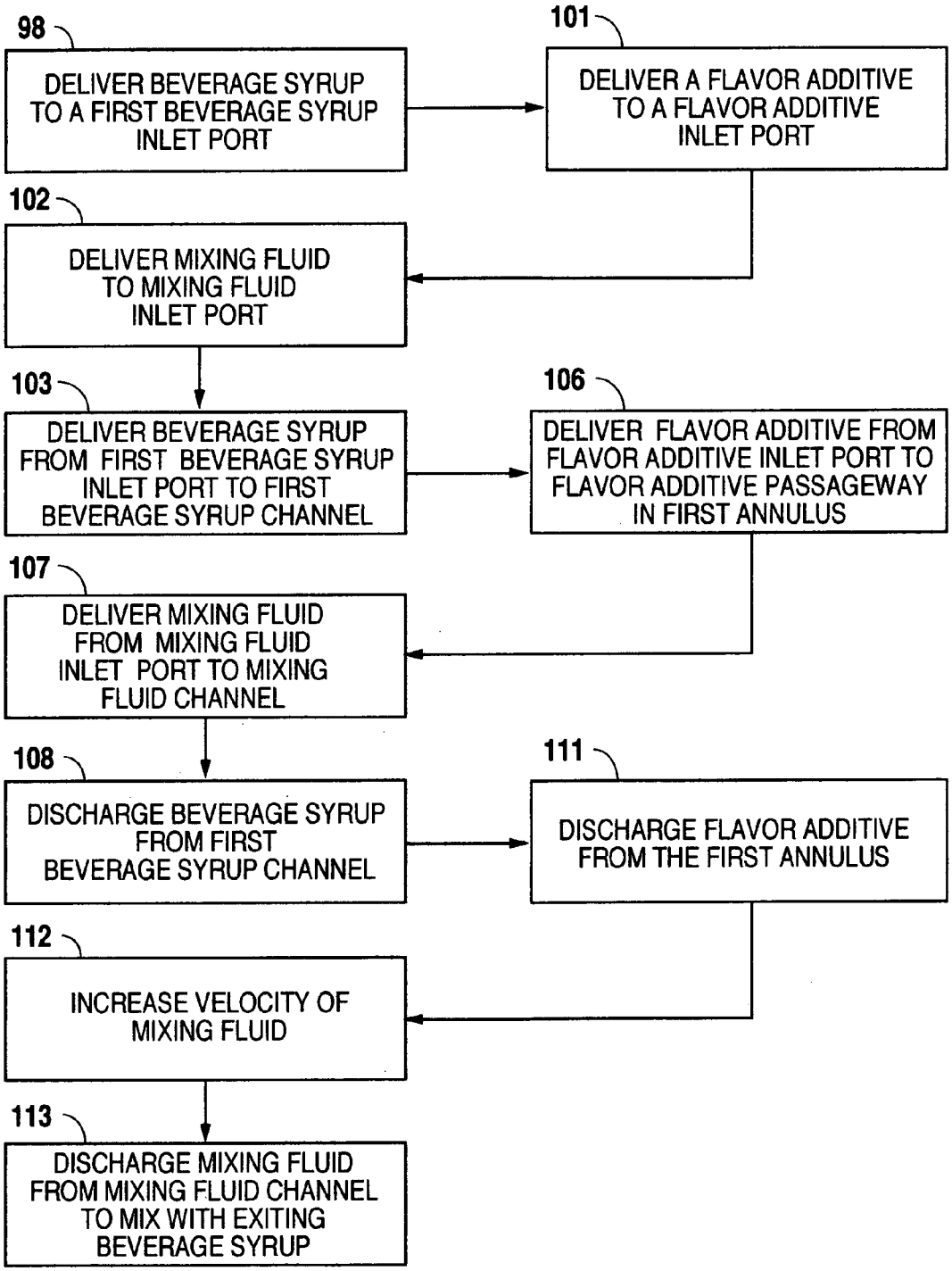
FIG. 11*d* provides a method flowchart for using flow directors in an embodiment that delivers flavor additives according to the preferred embodiment.

In an embodiment where a flavor additive is desired while using the beverage dispensing nozzle 900, the method flowchart of FIG. 11*a* further includes steps 101, 106 and 111 as shown in FIG. 11*d*. The process begins with step 98, wherein a beverage syrup is delivered to a first beverage syrup inlet port 21. The process then moves to step 101, wherein a flavor additive is delivered to a flavor additive inlet port 901. In step 102, a mixing fluid is delivered to a mixing fluid inlet port 27. Step 103 provides for delivering the beverage syrup from the first beverage syrup inlet port 21 to the first beverage syrup channel 54. The process then moves to step 106, wherein the flavor additive is then delivered from the flavor additive inlet port 901 to a flavor additive passageway 905 in the third annulus 919. Next, the mixing fluid is delivered from the mixing fluid inlet port 27 to the mixing fluid channel 72, step 107. The process continues with step 108, wherein the beverage syrup is discharged from the first beverage syrup channel 54. The process moves to step 111, wherein the flavor additive is discharged form the third annulus 919. In step 112, the velocity of the mixing fluid is increased as the mixing fluid passes the flow directors 200. Step 113 provides for discharging the mixing fluid from the mixing fluid channel 72 to contact exiting beverage syrup to mix therewith outside of the beverage dispensing nozzle 900.

Figure 12A:
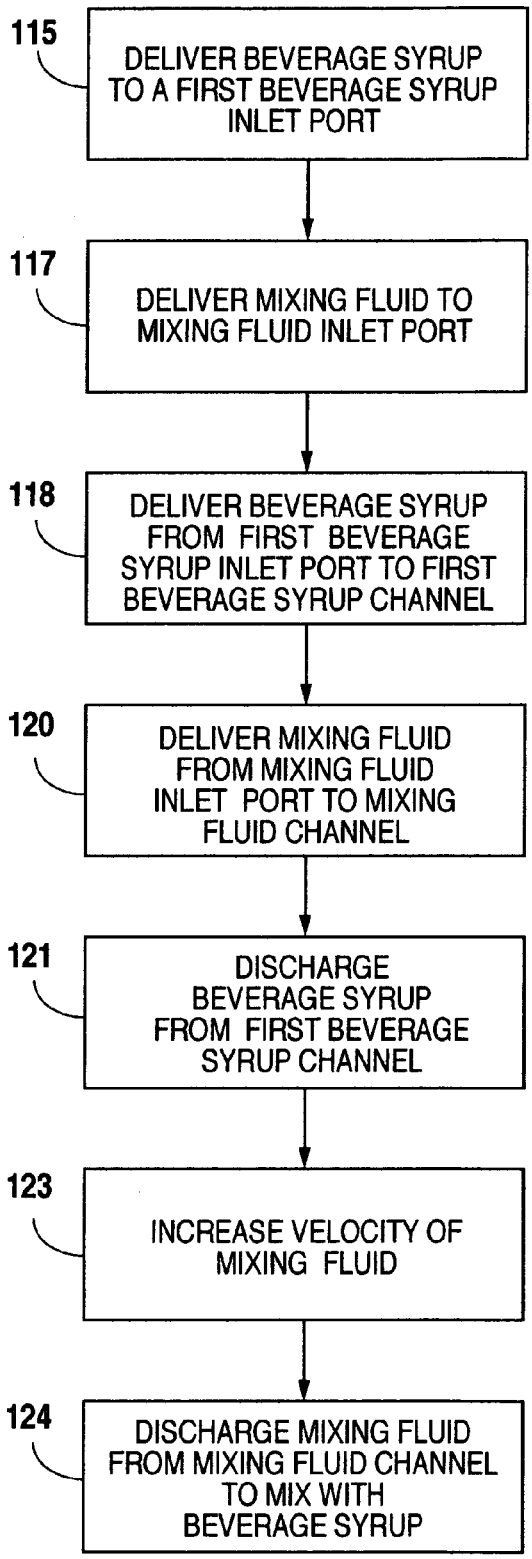
FIG. 12*a* provides a method flowchart for using flow directors in a standard beverage dispensing nozzle dispensing a single beverage flavor according to the preferred embodiment.

In another embodiment, the beverage dispensing nozzle 10 may be a standard beverage dispensing nozzle, i.e. not an air-mix beverage dispensing nozzle, wherein the beverage syrup and the mixing fluid streams mix in a mixing chamber prior to exiting the nozzle. The method flowchart for this embodiment is shown in FIG. 12*a*. The method process commences with step 115, wherein a beverage syrup is delivered to a first beverage syrup inlet port 21. In step 117, a mixing fluid is delivered to a mixing fluid inlet port 27. Step 118 provides for delivering the beverage syrup from the first beverage syrup inlet port 21 to the first beverage syrup channel 54. Next, the mixing fluid is delivered from the mixing fluid inlet port 27 to the mixing fluid channel 72, step 120. The process continues with step 121, wherein the beverage syrup is discharged from the first beverage syrup channel 54. In step 123, the velocity of the mixing fluid is increased as the mixing fluid passes the flow directors 200. Step 124 provides for discharging the mixing fluid from the mixing fluid channel 72 to mix with exiting beverage syrup.

Figure 12B:
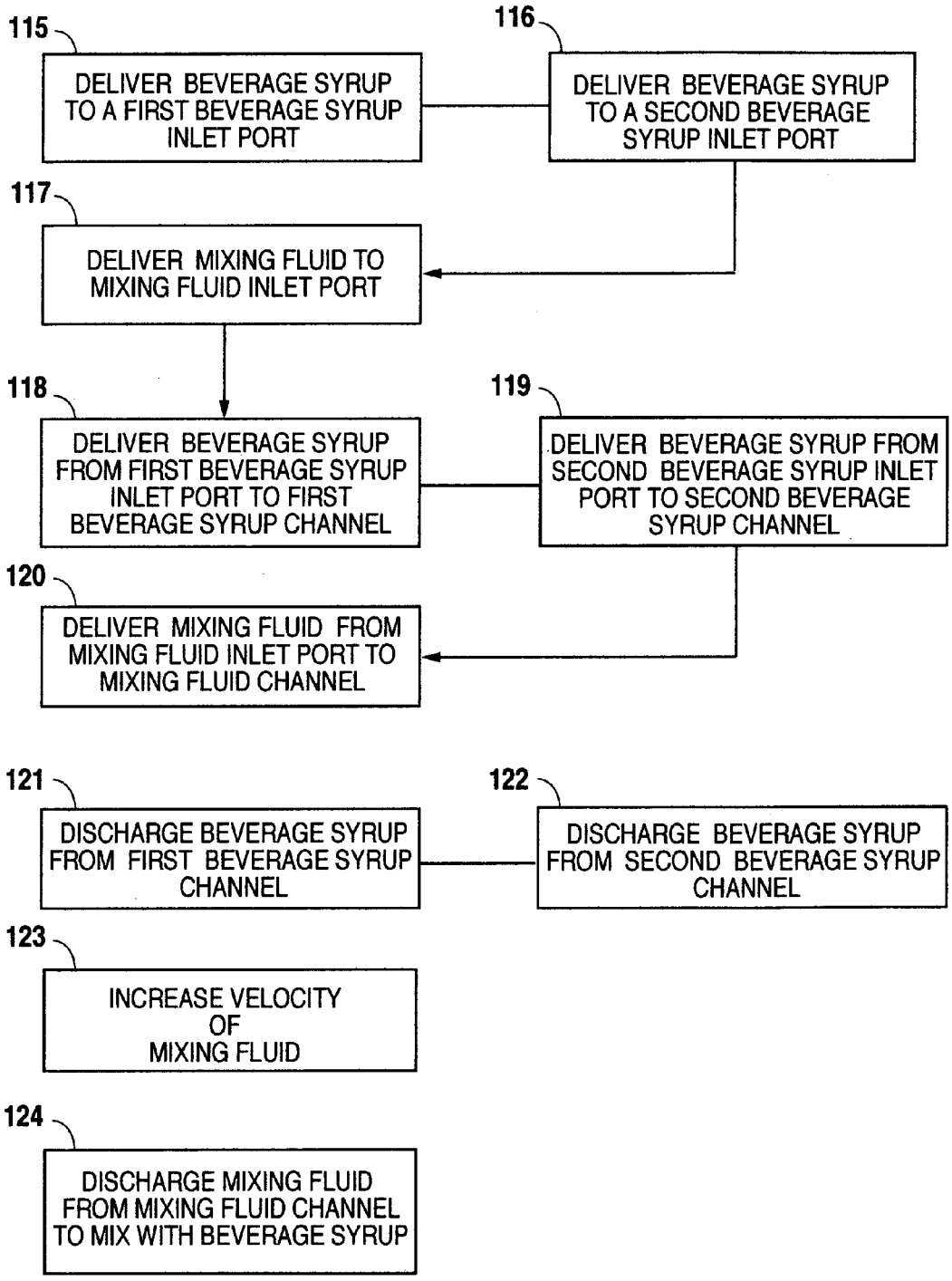
FIG. 12*b* provides a method flowchart for using flow directors in a standard beverage dispensing nozzle dispensing two beverage flavors according to the preferred embodiment.

A method flowchart for one variation of using flow directors 200 in an application with two beverage syrups is shown in FIG. 12*b*. Similar to the method shown in FIG. 12*a*, the process commences with a delivery of a first beverage syrup to a first beverage syrup inlet port 21, step 115. A second beverage syrup is then delivered to a second beverage syrup inlet port 22 in step 116. The process continues with the delivery of a mixing fluid to a mixing fluid inlet port 27 as shown in step 117. Step 118 provides for delivering the first beverage syrup from the first beverage syrup inlet port 21 to a first beverage syrup channel 54. Similarly, the second beverage syrup is delivered from the second beverage syrup inlet port 22 to a second beverage syrup channel 58 in step 119. Delivery of the mixing fluid from the mixing fluid inlet port 27 to a mixing fluid channel 72 follows in step 120. The first beverage syrup is then discharged from the first beverage syrup channel as shown in step 121. Likewise, the second beverage syrup is discharged from the second beverage syrup channel 58 in step 122. The velocity of the mixing fluid is increased in the mixing fluid channel 72 as it passes the flow directors 200 disposed therein in step 123. In step 124, the mixing fluid is discharged from the mixing fluid channel to mix with exiting beverage syrup.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

I claim:

1. A beverage dispensing nozzle, comprising:

a body including a syrup inlet port, a syrup discharge port, and a syrup flowpath therebetween;

the body further including a mixing fluid inlet port, a mixing fluid outlet port, and a mixing fluid channel disposed around the syrup flowpath; and at least one flow director disposed within the mixing fluid channel.

2. The beverage dispensing nozzle of claim 1, wherein the at least one flow director increases the velocity of the exiting mixing fluid.

3. The beverage dispensing nozzle according to claim 1, further comprising multiple flow directors that segment a lower portion of the mixing fluid channel into flow director channels.

4. The beverage dispensing nozzle of claim 3, wherein the multiple flow directors increase the velocity of the mixing fluid.

5. The beverage dispensing nozzle of claim 3, wherein the mixing fluid inlet port delivers mixing fluid to the flow director channels.

6. The beverage dispensing nozzle according to claim 1, wherein the beverage syrup exits in an annular discharge.

7. The beverage dispensing nozzle according to claim 1, wherein the body includes an inwardly extending lip portion for directing inward the flow of mixing fluid exiting the beverage dispensing nozzle.

8. The beverage dispensing nozzle of claim 1, wherein the body further comprises a flavor additive inlet port coupled to a flavor additive source, wherein the flavor additive inlet port communicates flavor additive to a flavor additive passageway of the body, wherein the body further comprises a flavor additive outlet port connected with the flavor additive inlet port, wherein the flavor additive passageway communicates flavor additive to the flavor additive outlet port of the body for discharge from the beverage dispensing nozzle.

9. The beverage dispensing nozzle of claim 1, wherein at least one flow director segments the mixing fluid stream, and provides the mixing fluid with an increased downward velocity component.

10. The beverage dispensing nozzle of claim 9, wherein the increased velocity component overcomes the surface tension of the mixing fluid, therein preventing intermingling between the mixing fluid and the syrup discharge ports.

11. The beverage dispensing nozzle of claim 1, wherein at least one flow director segments the mixing fluid and prevents training of the exiting mixing fluid to one end of the beverage dispensing nozzle.

12. A method of forming a beverage drink utilizing a beverage dispensing nozzle, comprising:

delivering a beverage syrup to a syrup inlet port of the beverage dispensing nozzle;

delivering a mixing fluid to a mixing fluid inlet port of the beverage dispensing nozzle;

delivering the beverage syrup from the syrup inlet port to a discharge port via a syrup flowpath disposed in the nozzle;

delivering the mixing fluid from the mixing fluid inlet port to a mixing fluid channel surrounding the syrup flowpath;

discharging the beverage syrup from the discharge port;

increasing the velocity of the mixing fluid in the mixing fluid channel; and discharging the mixing fluid from the beverage dispensing nozzle to contact exiting beverage syrup to mix therewith outside of the beverage dispensing nozzle.

13. The method of forming a beverage drink utilizing a beverage dispensing nozzle according to claim 12, wherein at least one flow director increases the velocity of the mixing fluid in the mixing fluid channel.

14. A beverage dispensing nozzle, comprising:

a cap member comprising a first beverage syrup inlet port coupled to a first beverage syrup source and a mixing fluid inlet port coupled to a mixing fluid source;

an inner housing coupled to the cap member, wherein the inner housing defines a chamber;

a first annulus disposed within the chamber of the inner housing, the first annulus and the inner housing defining a first beverage syrup channel, wherein the first beverage syrup inlet port communicates beverage syrup to the first beverage syrup channel for discharge from the beverage dispensing nozzle; and an outer housing coupled to the cap member, the outer housing and the inner housing defining a mixing fluid channel, wherein a lower portion of the mixing fluid channel is segmented by at least one flow director, therein creating at least one flow director channel, wherein the mixing fluid inlet port communicates mixing fluid to the mixing fluid channel and through the flow director channel for discharge from the beverage dispensing nozzle in a flow pattern surrounding the exiting beverage syrup to mix therewith outside the beverage dispensing nozzle.

15. The beverage dispensing nozzle according to claim 14, wherein the inner housing includes a first cavity therein connected with a first inner housing conduit that communicates with the first beverage syrup channel.

16. The beverage dispensing nozzle according to claim 15, wherein the cap member comprises a first beverage syrup outlet port connected with the first beverage syrup inlet port, wherein the first beverage syrup outlet port fits within the first cavity of the inner housing to couple the inner housing to the cap member and to communicate beverage syrup to the inner housing.

17. The beverage dispensing nozzle according to claim 14, wherein the cap member comprises a plurality of mixing fluid outlet channels connected to the mixing fluid inlet port and communicating with the mixing fluid channel for circumferentially delivering mixing fluid into the mixing fluid channel.

18. The beverage dispensing nozzle according to claim 14, wherein the cap member comprises a conduit connected to the mixing fluid inlet port and communicates with the inner housing for delivering mixing fluid through the center of the beverage dispensing nozzle.

19. The beverage dispensing nozzle according to claim 18, wherein a diffuser resides within the conduit for delivering mixing fluid through the center of the beverage dispensing nozzle.

20. The beverage dispensing nozzle according to claim 14, wherein the first annulus comprises a discharge member that restricts the flow pattern of the beverage syrup exiting the beverage dispensing nozzle to insure a uniform distribution.

21. The beverage dispensing nozzle according to claim 20, wherein the discharge member includes a plurality of discharge channels that aid the first beverage syrup channel in discharging the beverage syrup from the beverage dispensing nozzle.

22. The beverage dispensing nozzle according to claim 14, wherein the outer housing includes an inwardly extending lip portion for directing inward the flow of mixing fluid exiting the beverage dispensing nozzle.

23. A beverage dispensing nozzle, comprising:

a cap member comprising a first beverage syrup inlet port coupled to a first beverage syrup source, a second beverage syrup inlet port coupled to a second beverage syrup source, and a mixing fluid inlet port coupled to a mixing fluid source;

an inner housing coupled to the cap member, wherein the inner housing defines a chamber;

a first annulus disposed within the chamber of the inner housing, the first annulus and the inner housing defining a first beverage syrup channel, wherein the first beverage syrup inlet port communicates beverage syrup to the first beverage syrup channel for discharge from the beverage dispensing nozzle;

a second annulus disposed within the chamber of the inner housing, the second annulus and the first annulus defining a second beverage syrup channel, wherein the second beverage syrup inlet port communicates beverage syrup to the second beverage syrup channel for discharge from the beverage dispensing nozzle; and an outer housing coupled to the cap member, the outer housing and the inner housing defining a mixing fluid channel, wherein a lower portion of the mixing fluid channel is segmented by at least one flow director, therein creating at least one flow director channel;

wherein the mixing fluid inlet port communicates mixing fluid to the mixing fluid channel and through the flow director channel for discharge from the beverage dispensing nozzle and mixing with exiting beverage syrup.

24. The beverage dispensing nozzle according to claim 23, wherein the inner housing includes a first cavity therein connected with a first inner housing conduit that communicates with the first beverage syrup channel.

25. The beverage dispensing nozzle according to claim 24, wherein the cap member comprises a first beverage syrup outlet port connected with the first beverage syrup inlet port, wherein the first beverage syrup outlet port fits within the first cavity of the inner housing to couple the inner housing to the cap member and to communicate beverage syrup to the inner housing.

26. The beverage dispensing nozzle according to claim 23, wherein the cap member comprises a plurality of mixing fluid outlet channels connected to the mixing fluid inlet port and communicating with the mixing fluid channel for circumferentially delivering mixing fluid into the mixing fluid channel.

27. The beverage dispensing nozzle according to claim 23, wherein the outer housing includes an inwardly extending lip portion for directing inward the flow of mixing fluid exiting the beverage dispensing nozzle.

28. The beverage dispensing nozzle according to claim 23, wherein the inner housing includes a second cavity therein connected with a second inner housing conduit that communicates with the second beverage syrup channel.

29. The beverage dispensing nozzle according to claim 28, wherein the cap member further comprises a second beverage syrup outlet port connected with the second beverage inlet port, wherein the second beverage syrup outlet port fits within the second cavity of the inner housing to couple the inner housing to the cap member and to communicate beverage syrup to the inner housing.

30. The beverage dispensing nozzle according to claim 23, wherein the cap member further comprises a third beverage syrup inlet port coupled to a third beverage syrup source.

31. The beverage dispensing nozzle according to claim 30, further comprising a third annulus disposed within the chamber of the inner housing, the third annulus and the second annulus defining a third beverage syrup channel, wherein the third beverage syrup inlet port communicates beverage syrup to the third beverage syrup channel for discharge from the beverage dispensing nozzle.

32. The beverage dispensing nozzle according to claim 31, wherein the inner housing includes a third cavity therein connected with a third inner housing conduit that communicates with the third beverage syrup channel.

33. The beverage dispensing nozzle according to claim 32, wherein the cap member further comprises a third beverage syrup outlet port connected with the third beverage syrup inlet port, wherein the third beverage syrup outlet port fits within the third cavity of the inner housing to couple the inner housing to the cap member and to communicate beverage syrup to the inner housing.

34. The beverage dispensing nozzle according to claim 31, wherein the third annulus comprises a discharge member that restricts the annular flow pattern of the beverage syrup exiting the beverage dispensing nozzle to insure a uniform distribution.

35. The beverage dispensing nozzle according to claim 34, wherein the discharge member includes a plurality of discharge channels that aid the third beverage syrup channel in discharging the beverage syrup from the beverage dispensing nozzle.

36. A method of forming a beverage drink utilizing a beverage dispensing nozzle comprising:

delivering a beverage syrup to a first beverage syrup inlet port of a cap member;

delivering a mixing fluid to a mixing fluid inlet port of the cap member;

delivering the beverage syrup from the first beverage syrup inlet port to a first beverage syrup channel defined by an inner housing coupled with the cap member and a first annulus disposed in the inner housing;

delivering the mixing fluid from the mixing fluid inlet port to a mixing fluid channel;

discharging the beverage syrup from the first beverage syrup channel;

increasing the velocity of the mixing fluid in the mixing fluid channel; and discharging the mixing fluid from the mixing fluid channel in a pattern that contacts exiting beverage syrup to mix therewith outside the beverage dispensing nozzle.

37. The method of forming a beverage drink utilizing a beverage dispensing nozzle according to claim 36, wherein the mixing fluid velocity is increased through the use of at least one flow director.

38. The method of forming a beverage drink utilizing a beverage dispensing nozzle according to claim 36, further comprising:

delivering a beverage syrup to a second beverage syrup inlet port of the cap member;

delivering the beverage syrup from the second beverage syrup inlet port to a second channel defined by a second annulus disposed in the inner housing and the first annulus; and discharging the beverage syrup from the second beverage syrup channel.

39. The method of forming a beverage drink utilizing a beverage dispensing nozzle according to claim 38, further comprising:

delivering a beverage syrup to a third beverage syrup inlet port of the cap member;

delivering the beverage syrup from the third beverage syrup inlet port to a third beverage syrup channel defined by a third annulus disposed in the inner housing and the second annulus; and discharging the beverage syrup from the third beverage syrup channel.

40. The method of forming a beverage drink utilizing a beverage dispensing nozzle according to claim 36, further comprising:

delivering a flavor additive to a flavor additive inlet port of the cap member;

delivering the flavor additive from the flavor additive inlet port to a flavor additive passageway within the first annulus;

discharging the flavor additive from the first annulus.

41. A method of forming a beverage drink utilizing a beverage dispensing nozzle comprising:

delivering a beverage syrup to a first beverage syrup inlet port of a cap member;

delivering a mixing fluid to a mixing fluid inlet port of the cap member;

delivering the beverage syrup from the first beverage syrup inlet port to a first beverage syrup channel defined by an inner housing coupled with the cap member and a first annulus disposed in the inner housing;

discharging the beverage syrup from the first beverage syrup channel;

delivering the mixing fluid from the mixing fluid inlet port to a mixing fluid channel;

increasing the velocity of the mixing fluid in the mixing fluid channel; and discharging the mixing fluid from the mixing fluid channel and through the flow directors for mixing with beverage syrup.

42. The method of forming a beverage drink utilizing a beverage dispensing nozzle according to claim 41, further comprising:

delivering a beverage syrup to a second beverage syrup inlet port of the cap member;

delivering the beverage syrup from the second beverage syrup inlet port to a second beverage syrup channel defined by second annulus disposed in the inner housing and the first annulus; and discharging the beverage syrup from the second beverage syrup channel.

43. The method of forming a beverage drink according to claim 41, wherein the velocity of the mixing fluid is increased through the use of at least one flow directors.

44. A method of forming a beverage drink utilizing a beverage dispensing nozzle comprising:

delivering a beverage syrup to a first beverage syrup inlet port of a cap member;

delivering a beverage syrup to a second beverage syrup inlet port of the cap member;

delivering a mixing fluid to a mixing fluid inlet port of the cap member;

delivering the beverage syrup from the first beverage syrup inlet port to a first beverage syrup channel defined by an inner housing coupled with the cap member and a first annulus disposed in the inner housing;

discharging the beverage syrup from the first beverage syrup channel;

delivering the beverage syrup from the second beverage syrup inlet port to a second beverage syrup channel defined by a second annulus disposed in the inner housing and the first annulus;

discharging the beverage syrup from the second beverage syrup channel;

delivering the mixing fluid from the mixing fluid inlet port to a mixing fluid channel;

increasing the velocity of the mixing fluid in the mixing fluid channel; and discharging the mixing fluid from the mixing fluid channel for mixing with exiting beverage syrup.

45. The method of forming a beverage drink utilizing a beverage dispensing nozzle according to claim 44, further comprising:

delivering a beverage syrup to a third beverage syrup inlet port of the cap member;

delivering the beverage syrup from the third beverage syrup inlet port to a third beverage syrup channel defined by a third annulus disposed in the inner housing and the second annulus; and discharging the beverage syrup from the third beverage syrup channel.

46. The method of forming a beverage drink according to claim 44, wherein the velocity of the mixing fluid is increased through the use of flow directors.

* * * * *